United States Patent [19]

Braytenbah et al.

[11] 4,007,595

[45] Feb. 15, 1977

[54] DUAL TURBINE POWER PLANT AND A REHEAT STEAM BYPASS FLOW CONTROL SYSTEM FOR USE THEREIN

[75] Inventors: Andrew S. Braytenbah, Pennsauken, N.J.; Karl O. Jaegtnes, Chester, Pa.

[73] Assignee: Westinghouse Electric Corporation, Pittsburgh, Pa.

[22] Filed: Sept. 30, 1975

[21] Appl. No.: 618,096

[52] U.S. Cl. ..... 60/644; 60/658; 60/662; 60/663; 60/679; 60/706

[51] Int. Cl.[2] ..... F01K 7/22

[58] Field of Search ..... 60/644, 658, 660–663, 60/677, 679, 706

[56] References Cited

UNITED STATES PATENTS

| | | | |
|---|---|---|---|
| 2,672,732 | 3/1954 | Smith et al. | 60/660 X |
| 2,811,837 | 11/1957 | Eggenberger | 60/658 X |
| 2,902,831 | 9/1959 | Ipsen et al. | 60/663 X |
| 3,423,941 | 1/1969 | Evans | 60/658 |

FOREIGN PATENTS OR APPLICATIONS

| | | | |
|---|---|---|---|
| 282,657 | 11/1928 | United Kingdom | 60/660 |

*Primary Examiner*—Martin P. Schwadron
*Assistant Examiner*—H. Burks, Sr.
*Attorney, Agent, or Firm*—E. F. Possessky

[57] ABSTRACT

An electric power plant having dual turbine-generators connected to a steam source that includes a high temperature gas cooled nuclear reactor. Each turbine comprises a high pressure portion operated by superheat steam and an intermediate-low pressure portion operated by reheat steam; a bypass line is connected across each turbine portion to permit a desired minimum flow of steam from the source at times when the combined flow of steam through the turbine is less than the minimum. Coolant gas is propelled through the reactor by a circulator which is driven by an auxiliary turbine which uses steam exhausted from the high pressure portions and their bypass lines. The pressure of the reheat steam is controlled by a single proportional-plus-integral controller which governs the steam flow through the bypass lines associated with the intermediate-low pressure portions. At times when the controller is not in use its output signal is limited to a value that permits an unbiased response when pressure control is resumed, as in event of a turbine trip.

25 Claims, 2 Drawing Figures

DUAL TURBINE POWER PLANT AND A REHEAT STEAM BYPASS FLOW CONTROL SYSTEM FOR USE THEREIN

CROSS REFERENCES TO RELATED APPLICATIONS

Reference is made to the following previously filed and copending applications assigned to the present assignee:

"HTGR Power Plant Hot Reheat Steam Pressure Control System", Ser. No. 463,027, filed on Apr. 22, 1974 now U.S. Pat. No. 3,894,394 by Andrew S. Braytenbah and Karl O. Jaegtnes;

"HTGR Power Plant Turbine-Generator Load Control Systems", Ser. No. 464,027, filed on Apr. 25, 1974 by Andrew S. Braytenbah and Karl O. Jaegtnes;

"Load Control System Especially Adapted for HTGR Power Plant Turbine", Ser. No. 497,608, filed on Aug. 15, 1974 now U.S. Pat. No. 3,934,419 by Ola J. Aanstad;

"Acceleration Control Arrangement for Turbine System, Especially for HTGR Power Plant", Ser. No. 519,703, filed on Oct. 31, 1974 now U.S. Pat. No. 3,939,660 by Ola J. Aanstad;

"Dual Turbine Power Plant and Method of Operating Such Plant, Expecially One Having an HTGR Steam Supply", Ser. No. 571,145, filed on Apr. 24, 1975 by Andrew S. Braytenbah and Karl O. Jaegtnes;

"Electric Power Plant and Turbine Acceleration Control System for Use Therein", Ser. No. 618,098 filed Sept. 30, 1975 by Andrew S. Braytenbah and Karl O. Jaegtnes; and "Power Plant and System for Accelerating a Cross Compound Turbine in Such Plant, Especially One Having an HTGR Steam Supply", Ser. No. 618,097, filed Sept. 30, 1975 by Andrew S. Braytenbah and Karl O. Jaegtnes.

BACKGROUND OF THE INVENTION

A dual turbine power plant includes first and second turbine-generators connected to use steam from a common source. In a single turbine plant the steam source supplies one turbine-generator. A malfunction of the turbine-generator or its associated steam supply piping and steam condenser in such a single turbine plant may require shutting down the entire generating capacity until necessary repairs are made. In a dual turbine plant, however, such a malfunction may require shutting down one, but not both, of the turbine-generators, in which event one-half the generating capacity continues to operate while repairs are made.

In event that the steam source includes a high temperature gas cooled nuclear reactor, reactor-generated heat is delivered to a steam generator by a coolant gas that is circulated through the reactor and the steam generator. The steam generator is connected to supply super-heat and reheat steam to the dual turbine-generators. Each turbine comprises a high pressure portion driven by super-heat steam and a lower pressure portion driven by reheat steam. To protect the steam generator from low steam flow, a bypass line is connected across each of the turbine portions to permit at least a minimum flow of steam from the source when the turbine flow is less than the minimum. A gas circulator propels the coolant gas through the reactor and the steam generator; such a circulator advantageously may be driven by an auxiliary steam turbine which uses steam from the steam source. Typically such a turbine is connected to use steam emanating from the high pressure turbine portions and their bypass lines, before such steam is reheated.

In a power plant having turbines that use reheat steam it is desirable to control the pressure of such steam as it is discharged from the steam source, as a controlled pressure of that steam results in improved control of the speed or of the power output of the turbine portions which are driven by the reheat steam. If such a power plant includes a high temperature gas cooled reactor in its steam supply and auxiliary steam turbines as above described, such a controlled pressure further benefits control of the differential pressure across the auxiliary turbines, and thus improves control of the rotational speed of those turbines and of the flows of the coolant gas through the reactor.

In a proposed system for controlling the pressure of reheat steam in a power plant having a single turbine generator and a high temperature gas cooled nuclear reactor in its steam supply, a controller including both proportional and integral control modes governs the flow of reheat steam through a bypass line. However, application of two such controllers to operate in concert in a dual turbine plant may cause unwanted imbalance of the steam flows through the bypass lines which conduct reheat steam, as a result of the integral control modes.

In a proposed system for controlling the pressure of reheat steam in a dual turbine power plant which incorporates a high temperature gas cooled reactor in its steam supply, such pressure is controlled by dual proportional-only controllers, each of which governs the flow through a respective bypass line for conducting reheat steam, in order to regulate the pressure of the reheat steam. A limitation of the system is that it permits a non-zero steady state difference between the controlled pressure and its desired value. Another limitation is that an imbalance between the proportional gains of the two controllers may cause an imbalance between the flows through the bypass lines at times when the flows otherwise desirably would be balanced.

There appears to be a need for a system for controlling the pressure of reheated steam in a power plant that includes dual turbine-generators connected to a common steam source. Such a system desirably reduces a difference between a detected value of such pressure and a desired value of the pressure to a zero steady state level. A desirable feature of a power plant that includes the system is that there are no unwanted imbalances between the flows through the bypass lines that conduct reheated steam, which imbalances otherwise may result from changes of control gains that are used for regulating the flows through the bypass lines. An additional advantage of a power plant that includes the system is that reheated steam may be bypassed to an alternate steam receiving means to prevent a bypass flow of such steam to a condenser from exceeding a limit value which varies with a detected characteristic of the reheated steam. Thus an excessive heat dump rate to the condenser is prevented.

The description of prior art herein is made on good faith and no representation is made that any prior art considered is the best pertaining prior art nor that the interpretation placed on it is unrebuttable.

SUMMARY OF THE INVENTION

According to the present invention an electric power plant comprises a steam source to furnish steam to first and second turbine-generators, each including a high pressure turbine portion operated by superheat steam, a lower pressure turbine portion operated by reheat steam, and an electric generating means that is rotated by the turbine portions. First and second bypass means are connected to conduct reheat steam from the steam source, to permit passage of a minimum flow of reheat steam from the source when the flow of such steam through the turbines is less than the minimum. A measured value of the pressure of reheat steam is compared with a desired value of that pressure to detect a defference between such values, and the steam flows through the first and second bypass means are varied to reduce a detected difference to a zero steady-state level.

DESCRIPTION OF THE PREFERRED EMBODIMENTS

Figure 1:
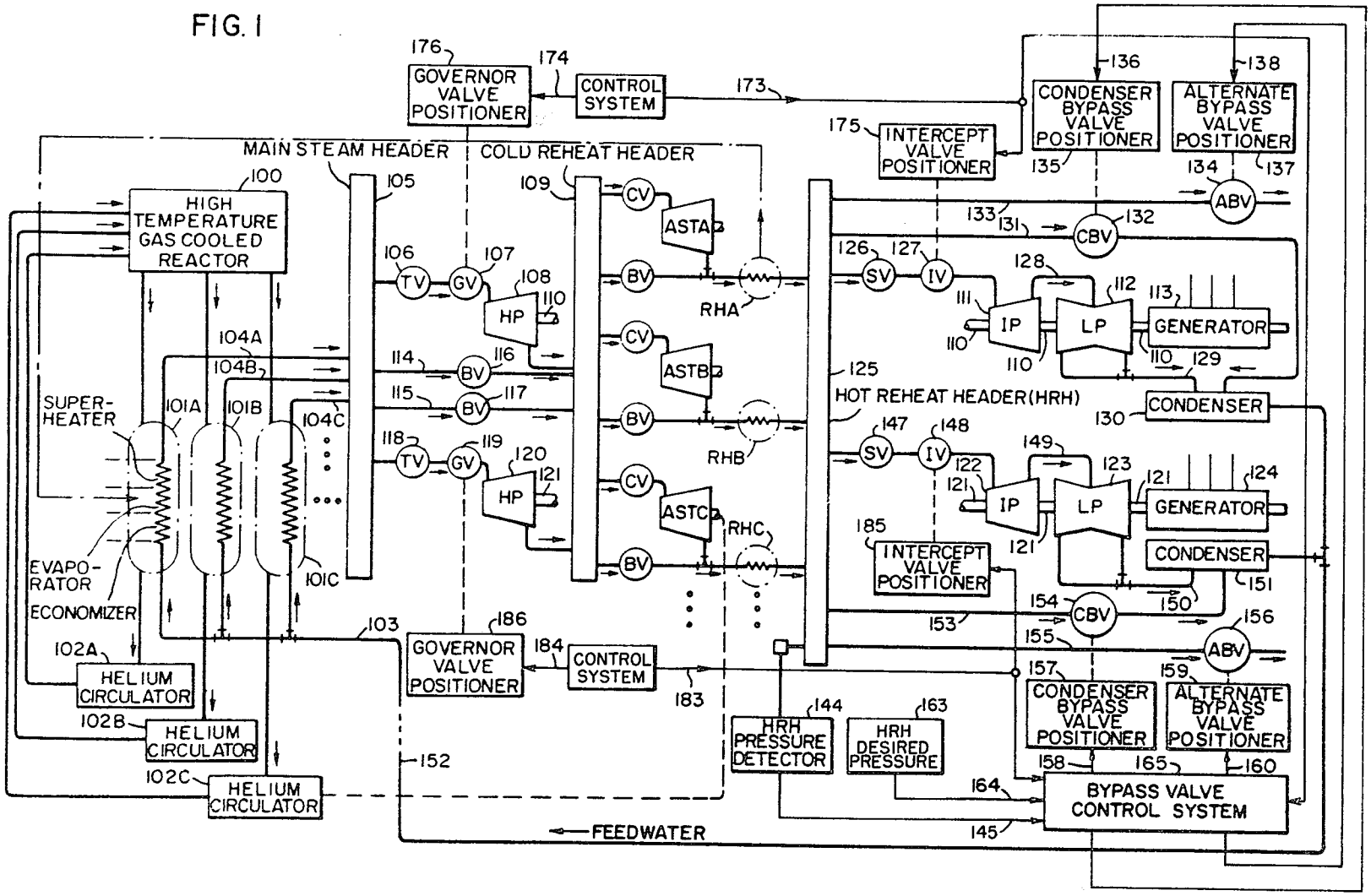
FIG. 1 schematically illustrates a dual turbine electric power plant according to one embodiment of the present invention.

Referring to FIG. 1 an electric power plant includes steam generators to supply superheat steam to a main steam header 105 and reheat steam to a hot reheat header 125. Dual turbine-generators use steam from the headers 105 and 125 to generate electrical power, a high pressure portion of each turbine being connected to the main steam header 105, and an intermediate-low pressure portion being connected to the hot reheat header 125. Rotatably coupled to each steam turbine is an electric generator which supplies power to a network (not shown).

Each of three helium circulators circulates helium coolant gas through a high temperature gas cooled reactor 100 and an associated steam generator. The steam generators 101A, 101B and 101C are associated with the helium circulators 102A, 102B and 102C respectively. Hot coolant gas is discharged from the reactor 100 and transports reactor-generated heat to each of the three steam generators. A steam generator derives heat from the reactor coolant gas flowing through it, to generate superheated and reheated steam. Feedwater is supplied to each of the steam generators through the line 103, and passes through economizer, evaporator and superheater sections in each steam generator. Superheated steam is discharged from the steam generators through the lines 104A, 104B and 104C, which conduct the superheated steam to a main steam header 105. Each steam generator also incorporates a reheater section, and utilizes reactor-generated heat to reheat a flow of steam through the reheater section. A dashed line illustrates the inclusion of a reheater section RHA in the steam generator 101A. Reheaters RHB and RHC similarly are included in the steam generators 101B and 101C. Cold reactor coolant gas is discharged from a steam generator and pumped back through the reactor 100 by the associated helium circulator. A typical HTGR power plant may employ a number different than three steam generators and associated helium circulators, depending upon the thermal generating capacity of the reactor 100. Additional steam generators would be connected to receive feedwater through the line 103 and to discharge superheated steam to the main steam header 105.

From the main steam header 105 steam may flow through a throttle valve 106 and a governor valve 107 to the inlet of a high pressure turbine 108. Exhaust steam from the high pressure turbine 108 is discharged to a cold reheat header 109. The high pressure turbine 108 turns on a shaft 110 with an intermediate pressure turbine 111, a low pressure turbine 112 and a generator 113, hereafter referred to as the A turbine-generator. Bypass lines 114 and 115 are connected between the main steam header 105 and the cold reheat header 109, and bypass valves 116 and 117 are connected to govern the steam flows through the lines 114 and 115 respectively. Steam also may flow from the main steam header 109 through a throttle valve 118, a governor valve 119, and a high pressure turbine 120, to the cold reheat header 109. The high pressure turbine 120 turns on a shaft 121 with an intermediate pressure turbine 122, a low pressure turbine 123, and a generator 124, hereafter referred to as the B turbine-generator.

For most desirable steam generator operation, the steam flow through the superheater sections must be maintained at a level which is at least equal to a desired minimum steam flow. When the combined steam flow through the turbines 108 and 120 is less than the desired minimum, the bypass valves 116 and 117 are positioned to maintain the desired minimum steam flow through the superheater sections. At times when the combined steam flow through the turbines 108 and 120 exceeds the desired minimum, the valves 116 and 117 are closed. A similar desired minimum steam flow should be maintained through the reheater sections. For purposes of this discussion, the desired minimum steam flow is sufficient to generate 25% of maximum power plant output. It is understood that the power output corresponding to the desired minimum steam flow may vary, depending upon the particular design of the steam generators. Typically each of the throttle valves 106 and 118 and each of the governor valves 107 and 119 corresponds to a plurality of such valves in practice.

An auxiliary steam turbine ASTA uses steam from the cold reheat header 119 to rotate the helium circulator 102A. Similarly auxiliary steam turbines ASTB and ASTC use steam from the cold reheat header 109 to rotate the helium circulators 102B and 102C respectively. A dashed line connecting the auxiliary steam turbine ASTC and the helium circulator 102C illustrates the rotational coupling of those elements. A control valve associated with each auxiliary steam turbine governs the steam flow through the auxiliary turbine, and thereby governs the rate of flow of reactor coolant gas through the corresponding helium circulator. Exhaust steam from the auxiliary steam turbine ASTA passes to the inlet of the reheater, RHA, and exhaust steam from the auxiliary steam turbines ASTB and ASTC similarly is discharged to the inlets of the respective reheaters RHB and RHC. A bypass line and bypass flow control valve are connected between the cold reheat header 109 and the inlet of each of the reheater sections RHA, RHB and RHC. At times when the total steam flow into the cold reheat header 109 exceeds the total steam flow through the auxiliary steam turbines, the bypass valves associated with the auxiliary steam turbines are positioned such that the bypass lines conduct the excess steam flow directly to the reheater section inlets. A hot reheat header 125 is connected to receive reheated steam from the outlets of the reheater sections. When more than three steam generators are utilized, the reheater section, the helium circulator and the auxiliary steam turbine corresponding to each additional steam generator are connected as above described.

From the hot reheat header 125 steam may flow through a stop valve 126 and an intercept valve 127 to the inlet of the intermediate pressure turbine 111. Exhaust steam from the turbine 111 flows through a line 128 to the inlet of the low pressure turbine 112. A line 129 conducts exhaust steam from the turbine 112 to a condenser 130. A condenser bypass line 131 is connected to conduct steam from the hot reheat header 125 to the condenser 130, and a condenser bypass valve 132 is connected to govern the steam flow through the line 131. An alternate bypass line 133 is connected between the hot reheat header 125 and an alternate steam receiving means, such as the atmosphere. An alternate bypass valve 134 is connected to govern the steam flow through the line 133. The valve 132 is positioned by a valve positioner 135, preferably an electrohydraulic positioner which hydraulically moves the valve 132 to a position related to an electrical signal transmitted to the positioner 135 on a line 136. The valve 134 is positioned by a valve positioner 137, preferably an electrohydraulic positioner which positions the valve 134 at a position related to an electrical input signal transmitted to the positioner 137 on a line 138.

An electrohydraulic valve positioner 175 postions the valve 127 to cause a steam flow through the turbines 111 and 112 that is effectively equal to the desired flow represented by the signal on the line 173. An electrohydraulic valve positioner 176 positions the governor valve 107 at a position represented by the signal on the line 174. For purposes of this discussion, the stop valve 126 and the throttle valve 106 are assumed to be open, unless otherwise stated. Thus the steam flow through the turbine 111 and 112 is governed by the intercept valve 127, and the steam flow through the turbine 108 is governed by the governor valve 107.

Steam may flow through a stop valve 147 and an intercept valve 148 to the inlet of the intermediate pressure turbine 122. Exhaust steam from the turbine 122 flows through a line 149 to the inlet of the low pressure turbine 123. After flowing through the low pressure turbine 123, steam is conducted by a line 150 to a condenser 151. Condensed feedwater from the condensers 130 and 151 flows through a line 152 to a series of pumps and heaters (not shown). Heated and pressurized feedwater is supplied to the steam generators through the line 103.

A condenser bypass line 153 is connected between the hot reheat header 125 and the condenser 151, and a condenser bypass valve 154 is connected to govern the steam flow through the line 153. An alternate bypass line 155 is connected between the hot reheat header 125 and an alternate steam receiving means, such as the atmosphere. An alternate bypass valve 156 is connected to govern the steam flow through the line 155. An electrohydraulic valve positioner 157 positions the valve 154 at a position related to a signal on an input line 158. An electrohydraulic valve positioner 159 positions the valve 156 at a position related to a signal on an input line 160. An electrohydraulic valve positioner 185 positions the valve 148 to cause a steam flow through the turbines 122 and 123 that is effectively equal to the desired flow represented by the signal on the line 183. An electrohydraulic valve positioner 186 positions the governor valve 119 at a position represented by the signal on the line 184. For the purposes of this discussion, it is assumed that the stop valve 147 and the throttle valve 118 are open, unless otherwise stated. Thus the steam flow through the turbines 122 and 123 is governed by the intercept valve 148, and the steam flow through the turbine 120 is governed by the governor valve 119.

A control system associated with the A turbine-generator generates output signals on the lines 173 and 174, such output signals representing desired positions of the intercept valve 127 and the governor valve 107, respectively. Generally, the signals on the lines 173 and 174 are varied by the control system for purposes of governing the power output of the A turbine-generator or for controllably accelerating the turbine-generator to synchronous speed prior to connecting the generator to its associated power network. The intercept valve 127 and the governor valve 107 are positioned according to the signals on the lines 173 and 174, whereby the steam flow through the turbines 111 and 112 and the flow through the turbine 108 are varied to control the speed or the power output of the A turbine-generator. The intercept valve 148 and the governor valve 119 are positioned in accordance with the signals on the lines 183 and 184, which signals are produced by a control system associated with the B turbine-generator. By positioning the governor valve 119 and the intercept valve 148, the control system varies with steam flow through the turbine 120 and the flow through the turbines 122 and 123 for purposes of governing the speed or the power output of B turbine-generator.

The pressure of steam in the hot reheat header 125 is detected by a pressure detector 144, and a signal representative of the detected pressure is transmitted on a line 145 to an input of a bypass valve control system 165. A device 163, such as an adjustable signal source or a digital computer with an analog output, generates a signal on a line 164 representative of a desired value of steam pressure in the hot reheat header 125. The line 164 is connected to an input of the bypass valve control system 165, as are the signals on the lines 173 and 183, representative of the demanded positions of the intercept valves 127 and 148. In response to the detected and desired pressure signals on the lines 145 and 164, and to the position demand signals on the lines 173 and 183, the bypass valve control system 165 generates output signals on the lines 136, 138, 158 and 160 to govern the steam flow through the bypass lines 131 and 133, and through the lines 153 and 155, for purposes of controlling the pressure of steam in the hot reheat header 125 and for maintaining the desired minimum steam flow through the reheater sections. At times when the total steam flow through the turbines 111 and 112 and through the turbines 122 and 123 is less than the desired minimum flow through the reheater sections, the bypass valve control system 165 varies the steam flows through the turbine bypass lines to maintain the desired pressure of steam in the hot reheat header 125, and thus to maintain the desired minimum flow to the reheater sections. The bypass valve control system also operates the bypass line control valves to control the pressure of steam in the hot reheat header 125 following a trip of one or both turbines.

Figure 2:
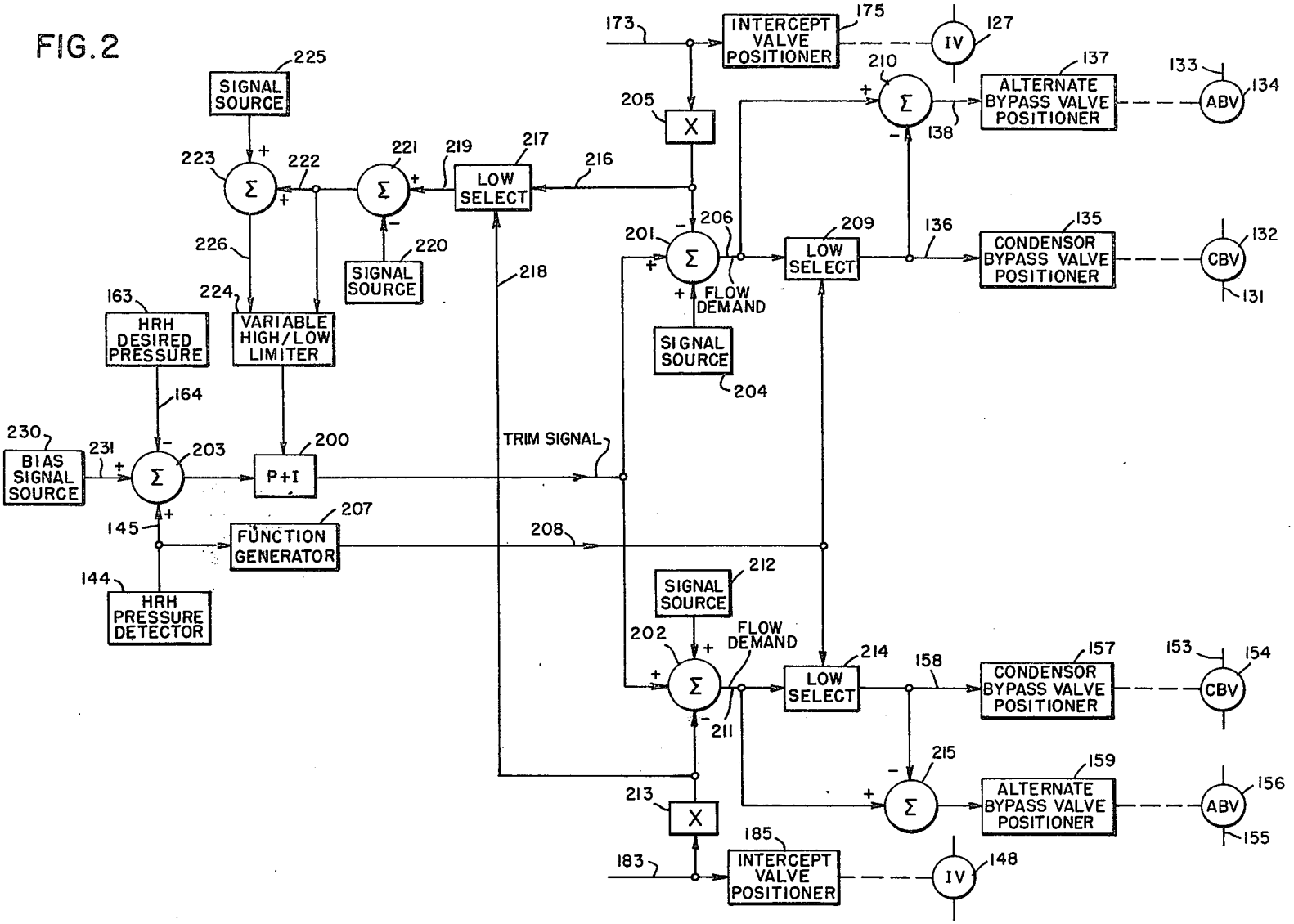
FIG. 2 shows schematic details of a bypass valve control system according to another embodiment of the present invention for use in the power plant shown in FIG. 1.

Referring now to FIG. 2, the bypass valve control system 165 is shown schematically. The desired pressure signal on the line 164 is compared with the detected pressure signal on the line 145 to generate a difference signal which is the input signal to a controller 200, preferably one having proportional and integral modes. The output signal of the controller 200 is transmitted to an input of each of summers 201 and 202, each of which summers generates an output signal which represents a demand for the combined steam flow through an associated condenser bypass line and an associated alternate bypass line. The condenser bypass valve is positioned in accordance with the output signal of its associated summer, the corresponding alternate bypass valve remaining closed unless the flow demand exceeds a limit which varies with a condition of steam in the hot reheat header 125. By controlling the bypass steam flows according to the output signals of the summers 201 and 202, the difference between the signals on the lines 145 and 164 is reduced. The output signal of the controller 200 continues to change, causing the output signals of the summers 201 and 202 to change, until a difference between the desired and detected pressures of steam in the hot reheat header 125 is reduced to zero, whereupon the detected value of the steam pressure is equal to the desired value of such pressure, as represented by the signal on the line 164.

A summer 203 generates the input signal to the controller 200 by subtracting the desired pressure signal on the line 164 from the detected pressure signal on the line 145. At the summer 201, the output signal of the controller 200 is summed with a constant signal generated by a signal generator 204, the output signal of the generator 204 representing a constant total steam flow through the lines 131 and 133 as hereinafter described. The signal on the line 173 is transmitted through a multiplier 205 to an input of the summer 201. The output signal of the summer 201 on a line 206 represents a demand for the combined steam flow through the lines 131 and 133. A function generator 207 is responsive to the detected pressure signal on the line 145 to produce an output signal on a line 208 which represents a maximum steam flow through the condenser bypass line 131 or through the condenser bypass line 153. The level of the output signal of the function generator 207 is inversely proportional to the level of the steam pressure in the hot reheat header 125. A low select 209 is responsive to the signals on the lines 206 and 208 and generates an output signal on the line 136 of a level equal to the lower of the signal levels on the lines 206 and 208. The line 136 is connected to the input of the condenser bypass valve positioner 135 as previously described. The lines 206 and 136 are connected to a summer 210, which generates an output signal on the line 138 by subtracting the signal on the line 136 from the signal on the line 206. The line 138 is connected to the input of the alternate bypass valve positioner 137 as previously described.

At times when the demand signal on the line 206 is less than the limit signal on the line 208, the output signal of the low select 209 has the level of the signal on the line 206. Then the condenser bypass valve 132 is positioned according to the demand signal on the line 206, the alternate bypass valve remaining closed, as the signal on the line 138 is zero.

At times when the demand signal on the line 206 exceeds the limit signal on the line 208, the low select 209 generates an output signal on the line 136 of a level equal to the level of the limit signal. Then the condenser bypass valve 132 is positioned according to the limit signal on the line 208. The signal on the line 138, however, represents the excess of the demand signal on the line 206 over the limit signal on the line 208; at such times the alternate bypass valve 134 is positioned according to such excess. Thus the valves 132 and 134 are positioned to produce a combined steam flow through the lines 131 and 133 that is in accordance with the demand signal on the line 206.

The output signal of the summer 202 is generated on a line 211 by summing the output signal of the controller 200 with the constant output signal of a signal generator 212, and subtracting the signal on the line 183, as transmitted to the summer 202 through a multiplier 213. The lines 208 and 211 are connected to inputs of a low select 214, which produces and output signal on a line 158 of a level equal to the lower of the levels of its input signals. The line 158 is connected to the input of the condenser bypass valve positioner 157, as previously described. The input signal to the alternate bypass valve positioner 159, on the line 160, is generated by a summer 215, which subtracts the output signal of the low select 214 from the output signal of the summer 202.

When the demand signal on the line 211 is less than the limit signal on the line 208, the signal on the line 160 is zero, and the alternate bypass valve 156 is closed. The low select 214 produces an output signal of a level equal to the level of the signal on the line 211, which causes the condenser bypass valve 154 to be positioned according to the demand signal on the line 211. If the demand signal on the line 211 exceeds the limit signal on the line 208, the low select 214 produces an output signal of level equal to the level of the limit signal, and the condenser bypass valve 154 is positioned according to the limit signal. Then the signal on the line 160 represents the excess of the demand signal on the line 211 over the limit signal on the line 208, and the alternate bypass valve 156 is positioned according to the excess. Thus the combined steam flow through the lines 153 and 155 is controlled according to the demand signal on the line 211.

The output signal of the multiplier 205 is transmitted on a line 216 to a first input of a low select 217. The output signal of the multiplier 213 is transmitted on a line 218 to a second input of the low select 217. Each of the multipliers 205 and 213 multiplies its input signal by a constant factor, in this case one-half, to generate its output signal. Thus the level of the signal on the line 216 is one-half the level of the input signal to the intercept valve positioner 175, and similarly the level of the signal on the line 218 is one-half the level of the input signal to the intercept valve positioner 185. The low select 217 generates a signal on an output line 219, the level of such signal being equal to the lower level of the signals on the lines 216 and 218.

A signal generator 220 generates a constant output signal that is transmitted to a first input of a summer 221. The signal on the line 219 is transmitted to a second input of the summer 221, which generates an output signal on a line 222 by subtracting the constant output signal of the generator 220 from the output signal of the low select 217. The line 222 is connected to an input of a summer 223 and to an input of a variable high-low limiter 224. Also connected to an input of the summer 223 is a constant output signal of a signal generator 225. The summer 223 adds the output signal of the generator 225 to the signal on the line 222 to generate a siganl on a line 226, which is connected to a second input of the variable high-low limiter 224.

The variable high-low limiter 224 is connected to the controller 200, which preferably has both proportional and integral modes; that is, the output signal of the controller 200 comprises the sum of a first signal that is proportional to the input signal with a second signal that is proportional to the time integral of the input signal. The purpose of the limiter 224 is to impose both high and low limits on the output signal of the integrator that is included in the controller 200 for time integrating the input signal to that controller. In particular, a low limit is imposed on the output signal of such integrator, the level of such low limit being equal to the level of the signal on the line 222. A high limit imposed on the output signal of the integrator has a level equal to the level of the signal on the line 226. The limit signals on the lines 222 and 226 vary at times, depending upon the level of the outputs signal of the low select 217. As long as its output signal level is within the limiting levels of the signals on the lines 222 and 226, the integrator included in the controller 220 continues to integrate the input signal. When the level of the output signal of such integrator reaches the level of one of the limiting signals on the lines 222 and 226, however, integration of the input signal ceases and is not resumed until such integration causes the level of the output signal to return to the range of acceptable values that is bounded above by the level of the signal on the line 226, and below by the level of the signal of the line 222. During resumption of integration, the output signal of the integrator remains at one of the limiting levels.

The level of each of the flow demand signals on the lines 206 and 211 varies from a low level corresponding to zero, that is, no steam flow through the associated bypass lines, to a high level corresponding to unity, that is, maximum steam flow. Each of the condenser bypass valve positioners 135 and 157 is arranged to close its associated valve in response to an input signal of the zero level, in response to an input signal of the unit level, each valve positioner fully opens its associated valve. As its input signal varies from zero to unit level, each of the valve positioners 135 and 157 is arranged so that the ratio of a change in the steam flow through its respective valve to the corresponding change in its input signal is substantially constant; in other words, the relationship between steam flow and input signal is linearized.

Each of the alternate bypass valve positioners 137 and 159 is arranged to close its associated valve in the response to an input signal of zero level; as its input signal increases from zero, each positioner is arranged to linearize the relationship between the steam flow through its valve and the level of its input signal. Each of the alternate bypass valve positioners includes an appropriate gain between the level of its input signal and the steam flow through its associated valve so that a signal of a given level on the line 206, for example, causes a corresponding bypass steam flow, whether that flow is through the condenser bypass line 131 alone, or jointly through the line 131 in combination with the flow through the alternate bypass line 133. Generally, such a gain is necessary because each of the valves 132, 134, 154 and 156 typically represents a plurality of such valves operating in concert. In practice the alternate bypass valves typically are fewer in number and smaller in size than the corresponding condenser bypass valves.

The signals on the lines 173 and 183 vary between a low signal level corresponding to zero and a high signal level corresponding to unity. Each of the valve positioners 175 and 185 responds to its input signal by opening its associated valve fully when the input signal is at the unit level, and by closing its associated valve fully when the input signal is at the zero level. As its input signal varies between the zero and unit levels each of the valve positioners 175 and 185 is arranged to cause the flow through its associated valve to vary linearly with its input signal. As will be seen, the steam flow through the intercept valve 147 or through the valve 148, when the valve is fully open, corresponds to a power output level of the associated generator that is approximately 25% of its maximum value, assuming that the pressure of steam in the hot reheat header 125 is at a low load pressure level.

Because each of the multipliers 205 and 213 multiplies its input signal by a constant factor, in this case one-half, the levels of the multiplier output signals vary between a low level corresponding to zero and a high level corresponding to one-half. Each of the signal generators 204 and 212 generates a constant signal of a level corresponding to one-half; assuming for the moment that there is no difference between the signals on the lines 145 and 164 and that the output signal of the controller 200 is at a zero level, it follows that the output signal of each of the summers 201 and 202 is at a level corresponding to one-half when its corresponding intercept valve positioner input signal is at zero level, and such output signal is at zero level when the valve positioner input signal is at unit level. Assuming that the pressure of steam in the hot reheat header 125 is at the low load level, an output signal of one of the summers 201 and 202 of level one-half causes a flow of steam through its associated alternate and condenser bypass lines that is equal to the flow of steam through the corresponding intermediate and low pressure turbine portions when the power output of the respective turbine-generator is 25% of its maximum value. When the output of such summer is at the zero level, the associated alternate and condenser bypass valves are closed, and no steam flows through the respective bypass lines. It should be understood that the bypass lines and their valves are designed so that the total bypass flow preferably is twice the steam flow through the intermediate and low pressure turbine portions when the power output of the turbine-generator is 100% of its maximum value, assuming that the pressure of steam in the hot reheat header 125 is at its full load value and that the output signal of the corresponding summer 201 or 202 is at unit level. Thus it follows that a flow demand of one-half, as generated by one of the summers 201 and 202, in conjunction with a pressure of steam in the hot reheat header 125 that is equal to the low load level (approximately ¼ the value of such pressure at maximum power output) corresponds to a flow of bypass steam equal to the turbine steam flow at 25% power output, as $\frac{1}{2} \times \frac{1}{4} \times 200\% = 25\%$.

At times when a turbine-generator is accelerated to synchronous speed prior to loading the generator, the steam flows through the turbine portions (see FIG. 1) are small in comparison with the corresponding levels of such flows at full power output. Then the input signal to the intercept valve positioner associated with the turbine-generator (see FIG. 2) is close to the zero level. Assuming that the pressure of steam in the hot reheat header 125 is at the low load level, and that the output signal of the controller 200 is at zero level, the flow demand signal associated with the turbine-generator corresponds to one-half, with the result that the bypass lines associated with the turbine-generator conduct a flow of steam approximately equal to the steam flow through the intermediate and low pressure turbine portions at 25% power output. When both turbine-generators are operated prior to loading, the total bypass steam flow from the hot reheat header 125 thus is equal to the desired minimum flow through the reheater sections.

After a turbine-generator is synchorinzed with the power network, the power output (load) of the generator is increased. Preferably, the governor valve and the intercept valve associated with the turbine-generator are opened so that the steam flow through their associated turbine portions are substantially equal at any load. As the power output of the turbine-generator is increased from zero to 25% of its maximum value, the input signal to its intercept valve positioner (see FIG. 2) increases from the zero level of such signal to the unit level of the signal. At the unit level, the steam flow through the intermediate and low pressure turbine portions corresponds to 25% power output, provided that the pressure of steam in the hot reheat header 125 is at the low load level. As the input signal to the intercept valve positioner increases from its zero level to its unit level, the output signal of the corresponding one of the summers 201 and 202 decreases from a level corresponding to one-half, to the zero level, provided that the output signal of the controller 200 is zero. Under such condition, the combined steam flow through the bypass lines associated with the intermediate and low pressure turbine portions, when the output signal of the associated summer is at ½ level, is equal to the steam flow through such turbine portions at 25% of the power output of the turbine-generator. When the output signal of the summer is at its zero level, the combined steam flow through the bypass lines is zero. As the input signal to an intercept valve positioner increases to raise the power output of a turbine-generator, the bypass steam flow associated with the intermediate and low pressure turbine portions correspondingly decreases. At times when the power output of the turbine-generator is less than 25% of its maximum value, the total steam flow through the intermediate and low pressure turbine portions and through their bypass lines thus is equal to one-half the desired minimum flow through the reheater sections (see FIG. 1). Therefore, the total steam flow through the intermediate and low pressure turbine portions of the A and B turbine-generators, and through their associated bypass lines, is equal to the desired minimum flow through the reheater sections, at times when the power output of each turbine-generator is less than 25% of its maximum value and the pressure of steam in the hot reheat header 125 is at its low load level.

At times when the combined power output of the A and B turbine-generators is less than 25% of the maximum plant power output (the plant output being the total electrical power produced by the generators 113 and 124 in FIG. 1), the reactor 100 and the helium circulators 102A–102C and their associated steam generators are operated to produce reheated steam at a pressure equal to the low load value and at a flow that is equal to the desired minimum flow. Thus, by varying the steam flows through the bypass lines so that the total steam flow from the hot reheat header 125 is equal to the desired minimum flow, as above described, the minimum flow through the reheater sections is maintained and the pressure of steam in the hot reheat header typically remains at its low load level. Because the steam pressure in the hot reheat header 125 importantly affects the pressure of steam at the steam inlets of the reheaters (see FIG. 1), it is evident that regulation of the pressure of steam in the hot reheat header 125 contributes improved regulation of the pressure differential across the auxiliary steam turbines, and thus permits improved control of the rotational speed of the auxiliary turbines. Such improved speed control results in improved control of the flows of coolant gas through the reactor 100, which flows generally must be carefully regulated as the power output of the power plant of FIG. 1 is varied.

With reference to FIG. 2, the desired pressure signal on the line 164 is set to represent the low load pressure value at times when the combined steam flow through the turbines 111 and 122 is less than the desired minimum flow. If the detected pressure of steam in the hot reheat header 125 deviates from the low load value, a non-zero signal is transmitted to the input of the pressure controller 200. In response, the controller 200 generates a trim signal which is transmitted to each of the summers 201 and 202 to cause the summers to vary their output signals so that the bypass steam flows associated with the intermediate and low pressure turbine portions, when varied in accordance with the output signals of the summers, cause a reduction of the difference between the signals on the lines 145 and 164. Thus a deviation of the pressure of steam in the hot reheat header 125 from the low load level is reduced by changing the steam flows through such bypass lines, thus changing the total steam flow from the hot reheat header 125. For example, an increase of the detected pressure over the low load level causes the output signal of the controller 200 to increase, thus increasing the flow demand signals generated by the summers 201 and 202. When the bypass steam flows are increased according to the increased flow demands, the pressure difference is reduced. Should the detected pressure fall below the low load value, the controller 200 diminishes its output signal, thus causing a decrease of the total bypass steam flow associated with the intermediate and low pressure turbine portions, which decrease in turn reduces the pressure difference. Because the controller 200 includes both proportional and integral modes, a difference between the signals on the lines 145 and 164 is reduced to a steady state value of zero. In the steady state, the detected pressure of steam in the hot reheat header 125 thus is held at the low load level.

At times when the total steam flow through the turbines 111 and 121 is less than the desired minimum flow through the reheater sections, operation of the reactor 100 and its associated helium circulators and steam generators to produce reheated steam at the low load pressure and at the desired minimum flow, together with operation of the bypass steam valves in response to the intercept valve positioner input signals as above described, generally ensures that the detected a steady-state flow of steam through the lines 131 and 133 in accordance with the flow demand signal on the line 206.

It is to be noted that the output signal of the controller 200 is at zero level immediately following the trip, and thus is advantageously unbiased in that it may begin to increase or decrease after the trip, as the particular circumstances require. A non-zero level of such signal immediately following the trip, for example, a positive level, would disadvantageously bias the trim signal in event that pressure deviation correction requires generation of a negative-going trim signal. Such bias unfavorably increases both the time duration and the amount of a post-trip transient deviation of steam pressure in the header 125.

It is further noted that the post-trip range of the trim signal that is permitted by the signal from the lines 222 and 226 is bounded below by minus one-half and above by plus one-half; since the level of the signal on the line 206 at zero output signal of the controller 200 is one-half, it follows that the permitted post-trip range of the trim signal is sufficient to terminate flow through the lines 131 and 133 (zero flow demand) or to double the demand for such flow from its initial post-trip value (unit flow demand). Thus, adequate range of the trim signal is provided to meet the requirements of all circumstances.

In summary, in response to a trip of the A turbine-generator a flow demand signal is generated on the line 206 of level that corresponds to the flow through the turbines 111 and 112 before the trip. Such flow demand is generated very quickly in response to the trip, since the flow demand signal on the line 206 is responsive to the signal on the line 173 through the multiplier 205, which multiplier poses negligible time delay. Thus, a demand is quickly generated for a flow of steam through the lines 131 and 133 that is effectively equal to the flow through the associated intermediate and low pressure turbine portions before the trip. At the same time, operation of the controller 200 is resumed by zeroing the signal on the line 231, whereupon the detected pressure of steam in the header 125 is compared with its value immediately preceding the trip, and the controller generates a trim signal to modify the flow demand signal on the line 206, to reduce any post-trip pressure deviation from the pre-trip value. As a result, steam flow through the turbines 111 and 112 is transferred quickly to the lines 131 and 133 after the turbine trip and the steam pressure and the header 125 is stabilized at its pre-trip level. Consequently, post-trip variation of the pressure of steam at the inlets of the reheaters (see FIG. 1) is favorably reduced, as is post-trip variation of the flows of coolant gas through the reactor 100, for reasons previously explained.

In event of a trip of both the A and B turbine-generators (see FIG. 1) during operation in the previously described tracking mode, the system shown in FIG. 2 operates to reduce substantially post-trip variation of the steam pressure in the hot reheat header 125. Immediately following such a trip, the intercept valve positioner input signals on the lines 173 and 183 are reduced quickly to levels corresponding to zero by the control systems shown in FIG. 1. The signal on the line 231 is set at a level corresponding to zero, to permit the pressure controller 200 to resume controlling the steam pressure in the header 125.

Since the signals on the lines 173 and 183 are both at a pre-trip level corresponding to unity, the trim signal on the line 200 is at a low limit of zero before and immediately after the trip. With each of the signals on lines 173 and 183 reduced to a post trip-level corresponding to zero, each of the flow demand signals on the lines 206 and 211 is at a level corresponding to one-half; as previously explained, a flow demand of such level causes a total post-trip steam flow through the associated condenser and alternate bypass lines that is effectively equal in the steady state to the pre-trip steam flow through the corresponding intermediate and low pressure turbine portions, provided that the pressure of steam in the header 125 remains at its pre-trip level.

In response to the flow demand signals of level one-half, the alternate and condenser bypass valves associated with each turbine-generator are positioned to permit steam flows through their bypass lines of such level that the total steam flow through the lines is effectively equal to the pre-trip flow through the intermediate and low pressure portions of the tripped turbine. Because both bypass systems are operated, it follows that the steam flow through all of the bypass lines is approximately equal to the flow of reheated steam into the header 125 (see FIG. 1) and large transient variations of the steam pressure in the header 125, from the pre-trip level of that pressure, are eliminated.

After the trip, tracking mode operation of the pressure controller 200 is discontinued, and the desired pressure signal on the line 164 remains at a level which represents the pressure of steam in the header 125 just before the trip. Thus, the post-trip detected steam pressure in the header 125, as represented by the signal on the line 145, is compared with the desired value of such pressure; should a difference between the pressures occur, the controller 200 generates a trim signal which modifies the flow demand signals on the lines 206 and 211. When the alternate and condenser bypass valves are positioned according to the modified flow demand signals, a difference between the desired and detected steam pressures in the header 125 is reduced. Thus, the controller 200 operates to regulate the post-trip steam pressure in the header 125 according to the value of that pressure immediately preceding the trip in event that the flow demand signals on the lines 206 and 211 of level one-half permit deviation of such pressure from its desired level. As previously explained, such pressure regulation improves control of the rotational speed of each of the auxiliary steam turbines (see FIG. 1) and control of its corresponding flow of coolant gas through the reactor 100.

We claim:

1. A power plant comprising, a steam source to generate superheat and reheat steam, a first turbine-generator including at least a first high-pressure turbine portion operated by superheat steam, a first lower pressure turbine portion operated by reheat steam, and an electric generating means rotatably driven by said first high and first-lower pressure turbine portions, a second turbine-generator including at least a second high-pressure turbine portion operated by superheat steam, a second lower pressure turbine portion operated by reheat steam, and an electric generating means rotatably driven by said second high and second lower pressure turbine portions, first bypass means for conducting reheat steam from said steam source, pressure of steam in the hot reheat header remains effectively at the low load level. In the event that the reactor and steam generators are not operated to produce reheated steam at the above stated flow and pressure level, or that the bypass steam flows do not vary as above described, possibly due to a malfunction, a pressure deviation occurs, and the pressure controller 200 varies its output signal to reduce the deviation.

At times when the total steam flow through the turbines 111 and 121 exceeds the desired minimum flow through the reheater sections, a trim signal is generated of sufficiently low level to ensure that the alternate and condenser bypass valve associated with each turbine-generator remain closed. At such times the output signal of a bias signal source 230 is introduced to a third input of the summer 203 on a line 231. It should be understood that the output signal of the source 230 is zero at times when the controller 200 is used to generate a trim signal for purposes of controlling the pressure of steam in the hot reheat header 125. However, when the total steam flow through the turbines 111 and 121 exceeds the desired minimum flow, the output signal of the source 230 remains at a non-zero level that causes a negative output signal of the summer 203. In response the integrator that is included in the controller 200 integrates downwardly until its output reaches the low level that is represented by the signal on the line 222. The trim signal then remains at such level to hold the alternate and condenser bypass valves closed. Thus, at plant power output levels that require more steam flow through the turbines 111 and 121 than the desired minimum, no steam flows through the bypass lines associated with the intermediate and low pressure turbine portions, and the pressure of steam in the hot reheat header 125 increases above the low load value as the plant power output increases.

At times when the total steam flow through the turbines 111 and 121 exceeds the desired minimum flow through the reheater sections, the level of the desired pressure signal on the line 164 is set to equal the level of the detected pressure signal on the line 145, a mode of operation hereinafter referred to as the tracking mode. As above described the signal on the line 231 causes the controller 200 to reduce the level of the trim signal to the limit set by the signal on the line 222. Because each of the signals on the lines 173 and 183 is at a level corresponding to unity, the low select 217 produces an output signal on the line 219 of level one-half, as each of the multipliers 205 and 213 multiplies its input signals in this case by a factor of one-half. The constant output signal of the source 220 is of a level corresponding to one-half; therefore, the signal on the line 222 corresponds to zero. The constant output signal of the source 225 is of level corresponding to unity; thus the signal on the line 226 is of unit level. Therefore, during operation in the tracking mode, the output signal of the controller 200 is reduced to a level corresponding to zero, in response to the signal on the line 231.

In event of a trip of one or both of the turbines during operation in the above described tracking mode, the input signal to the intercept valve positioner associated with the tripped turbine is reduced very quickly to a level corresponding to zero by its control system shown in FIG. 1. If the A turbine-generator is tripped, for example, the low select 217 shown in FIG. 2 receives a signal of level corresponding to zero on the line 216 and consequently produces a zero level signal on its output line 219. As a result, the low limit signal on the line 222 is of level corresponding to minus one-half, while the high limit signal on the line 226 is of level corresponding to plus one-half. Since it is desirable to control the pressure of steam in the hot reheat header 125 in response to such a trip, the bias signal on the line 231 is set at a level corresponding to zero, to permit the controller 200 to commence such pressure control.

Continuing the example of a trip of the A turbine-generator, the output signal of the multiplier 205 is reduced to a level corresponding to zero in response to the fast reduction of the signal on the line 173. Since the output signal of the controller 200 was limited to zero level during operation under a bias signal on the line 231 prior to the trip, it follows that the trim signal is of zero level immediately after the trip. Therefore, the flow demand signal on the line 206 has a level corresponding to one-half immediately following the trip.

As previously stated a flow demand signal on the line 206 of level one-half causes a flow of steam through the lines 131 and 133 equal to the steam flow through the turbines 111 and 112 at 25% power output of the A turbine-generator, provided that the pressure of steam in the hot reheat header 125 is at the low load level. The combined steam flow through the lines 131 and 133 varies approximately linearly with the pressure of steam in the hot reheat header 125 for a given flow demand signal on the line 206; in particular, such combined flow is equal to the flow through the turbines 111 and 112 at 100% power output of the A turbine-generator, provided that the pressure of steam in the hot reheat header 125 is at the level corresponding to that power output. Because the steam pressure in the header 125 is permitted to increase with plant load, it follows that the level (one-half) of the flow demand signal on the line 206 is appropriate to cause a flow of steam through the bypass lines 131 and 133 after the trip that is effectively equal to the steam flow through the turbines 111 and 112 before the trip.

In order to prevent the pressure of steam in the hot reheat header 125 from undergoing large post-trip deviations from its value before the trip, it is necessary that the steam flow through the turbine 111 and 112 be transferred as quickly as possible to the associated bypass lines. This transfer is effected first by generating a flow demand signal on the line 206 that corresponds to the flow through the turbines 111 and 112 before the trip. After the trip, the valve positioners 135 and 137 position the bypass valves in accordance with the signal on the line 206, to cause a flow through the lines 131 and 133 that is effectively equal to the flow through the turbines 111 and 112 before the trip.

Immediately after the trip, operation in the above-described tracking mode is discontinued, and the signal on the line 164 continues to represent a desired pressure of steam in the header 125 that is equal to the detected value of such pressure immediately preceding the trip. Thus, the controller 200 responds to the output signal of the summer 203 to generate a trim signal to correct a deviation of the detected pressure of steam in the header 125 from its value before the trip. Such trim signal generation for pressure correction is especially helpful, for example, to reduce transient deviations of the pressure of steam in the header 125 that otherwise may result from the finite amount of time required to move the bypass valves 132 and 134 from their initial positions to the positions necessary to cause second bypass means for conducting reheat steam from said steam source, and means for comparing a measured value of the pressure of reheat steam with a desired value of such pressure to detect a difference between such values, and for varying the combined steam flow through said first and second bypass means to reduce a detected difference to a zero steady state level.

2. A power plant according to claim 1 wherein said steam source includes a high-temperature gas-cooled nuclear reactor, and a steam generator derives heat from the reactor coolant gas to produce the superheat and reheat steam.

3. A power plant according to claim 2 further comprising, an auxiliary steam turbine means connected to pass at least a portion of the steam that is reheated by said steam source, said auxiliary steam turbine means being rotatably coupled to drive a means for circulating the coolant gas through said reactor and said steam generator.

4. A power plant according to claim 1 wherein said first bypass means comprises a line for conducting reheated steam from said steam source to a steam exhaust of said first lower-pressure turbine portion and said second bypass means comprises a line for conducting reheated steam from said steam source to a steam exhaust of said second lower pressure turbine portion.

5. A power plant according to claim 4 further comprising a third bypass means for conducting reheated steam from said steam source to an alternate steam receiving means, and said means for comparing includes means for determining a limit value of the steam flow through each of said first and second bypass means, and for varying the steam flow through said third bypass means to prevent each of the steam flows through said first and second bypass means from exceeding the limit value.

6. A power plant according to claim 1 wherein said means for comparing includes means for generating a trim signal that is the sum of a first signal which is proportional to the detected difference between pressure values with a second signal which is proportional to the time integral of such difference, and the steam flows through said first and second bypass means are varied at least in response to the trim signal.

7. A power plant according to claim 6 wherein the steam flow through each of said first and second bypass means is varied in accordance with a respective flow demand signal which is the sum of the trim signal with a constant level signal, diminished by a signal that is related to the steam flow through its associated lower pressure turbine portion.

8. A power plant according to claim 7 further comprising first and second intercept valve means connected to control the steam flows through said first and second lower pressure turbine portions respectively, the signal that is related to the steam flow through a lower pressure turbine portion being a demanded position of its associated intercept valve means.

9. A power plant according to claim 8 wherein each of said first and second intercept valve means is arranged so that the steam flow through its related lower pressure turbine portion varies linearly with the demanded position of the valve means.

10. A system for controlling the pressure of reheated steam that is produced by a steam source for use by the lower pressure turbine portions of first and second turbine-generators in an electric power plant having first and second bypass means connected to conduct reheated steam from the source, such source being operated to produce the reheated steam at a desired minimum flow and at a low load pressure level corresponding to the minimum flow said system comprising, means for producing first and second signals representative of the steam flows through the respective low pressure portions of the first and second turbine generators, and control means responsive to the first and second signals for detecting an excess of the desired minimum flow over the total flow through the lower pressure turbine portions, and for varying the steam flow through the first and second bypass means to cause passage of the excess flow through such bypass means, whereby the low load pressure level is maintained.

11. A system according to claim 10 wherein said means for producing includes first and second intercept valve means associated with the respective lower pressure turbine portions and connected to control the flows of steam therethrough, each of said intercept valve means being positioned by a corresponding valve positioner, the first and second signals being the input position demand signals to the valve positioners associated with the first and second intercept valve means respectively.

12. A system according to claim 11 wherein an intercept valve means and its associated positioner are arranged to cause a linear relationship between flow through the valve means and the input position demand, at a constant valve means inlet pressure.

13. A system according to claim 10 wherein the steam flow through each of the first and second bypass means is controlled to compensate changes of the flow through its associated lower pressure turbine portion, whereby the total flow through a bypass means and its associated turbine portion is effectively equal to a fixed value at times when the flow through the turbine portion is less than such valve.

14. A system according to claim 13 wherein the fixed value of the total flow through a bypass means and its associated lower pressure turbine portion is one-half the desired minimum flow.

15. A system according to claim 10 wherein each of the first and second bypass means includes a condenser bypass line connected to conduct reheated steam from the source to the steam exhaust of the lower pressure turbine portion, and an alternate bypass line connected to conduct reheated steam to an alternate steam receiving means, and said control means is further responsive to a power plant variable related to the heat content of the reheated steam for varying the steam flow through the alternate bypass line to prevent the flow of heat through the condenser bypass line from exceeding a limit value.

16. A system according to claim 15 wherein the power plant variable related to the heat content of the reheated steam is the pressure of such steam as it is discharged from the steam source.

17. A system according to claim 10 further comprising a pressure detector connected to measure the pressure of reheated steam upon its discharge from the steam souce and to generate a third signal representative of the measured pressure, and wherein said control means is further responsive to the third signal for detecting a difference between the measured pressure value and the low load value and for varying the steam flow through the first and second bypass means to reduce a detected difference.

18. A system according to claim 17 wherein a detected pressure difference is reduced to a zero steady state level.

19. A system according to claim 17 wherein said control means includes means for generating a trim signal that is the sum of a first signal which is proportional to a detected pressure difference with a second signal which is proportional to the time integral of such difference, and for varying the steam flow through the first and second bypass means in response to the trim signal at times when control of such flows in accordance with the first and second signals alone permits a pressure difference.

20. A system according to claim 19 furter comprising means for generating a bias signal which is transmitted to the input of the trim signal generating means to cause a trim signal of such level that the steam flows through the first and second bypass means are terminated at times when the combined flow through the lower pressure turbine portions exceeds the desired minimum.

21. A system according to claim 19 further comprising limiting means responsive to the first and second signals for preventing the trim signal from decreasing below a distinct lower limit at times when there is a continuing non-zero pressure difference.

22. A system according to claim 21 wherein the value of the lower limit is zero, to permit resumption of the control of the pressure of the reheated steam without control bias, after the non-zero pressure difference is discontinued.

23. A system according to claim 21 wherein said limiting means further prevents the trim signal from exceeding a distinct upper limit, the value of the upper limit permitting the trim signal to cause a full flow of steam through the first or second bypass means at any level of the steam flow through the corresponding lower pressure turbine portion.

24. A system according to claim 23 wherein the upper and lower limits are established in relation to the level of that one of the first and second signals having the lower signal level, or in response to the level of either of such signals when the levels are equal.

25. A system according to claim 24 wherein the lower limit value is determined by subtracting a constant of value one-half from one-half the value of that one of the first and second signals to which the limits are related, the value of the upper limit being the value of the lower limit increased by unity.

* * * * *